US006361162B1

(12) United States Patent
Penrod et al.

(10) Patent No.: US 6,361,162 B1
(45) Date of Patent: Mar. 26, 2002

(54) METHOD AND APPARATUS FOR FIXING INK TO A PRINT RECEIVING MEDIUM

(75) Inventors: Michael Adam Penrod, Lexington; Richard Lee Reel, Georgetown; Timothy Joseph Stephany, Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/516,703

(22) Filed: Mar. 1, 2000

(51) Int. Cl.[7] ..... B41J 02/01
(52) U.S. Cl. ..... 347/102
(58) Field of Search ..... 347/102, 101; 101/488; 219/216

(56) References Cited

U.S. PATENT DOCUMENTS

| | | | | | |
|---|---|---|---|---|---|
| 4,951,067 | A | | 8/1990 | Spehrley, Jr. | |
| 4,971,408 | A | | 11/1990 | Hoisington et al. | |
| 5,021,805 | A | | 6/1991 | Imaizumi et al. | |
| 5,041,846 | A | | 8/1991 | Vincent et al. | |
| 5,055,861 | A | | 10/1991 | Murayama et al. | |
| 5,148,186 | A | * | 9/1992 | Tochihara et al. | 347/102 |
| 5,212,498 | A | | 5/1993 | Sugimori | |
| 5,249,062 | A | | 9/1993 | Ejiri et al. | |
| 5,274,400 | A | | 12/1993 | Johnson et al. | |
| 5,296,873 | A | | 3/1994 | Russell et al. | |
| 5,329,295 | A | | 7/1994 | Medin et al. | |
| 5,406,316 | A | | 4/1995 | Schwiebert et al. | |
| 5,428,384 | A | | 6/1995 | Richtsmeier | |
| 5,461,408 | A | | 10/1995 | Giles et al. | |
| 5,467,119 | A | | 11/1995 | Richtsmeier et al. | |
| 5,500,667 | A | | 3/1996 | Schwiebert et al. | |
| 5,510,822 | A | | 4/1996 | Vincent et al. | |
| 5,570,118 | A | | 10/1996 | Rezanka et al. | |
| 5,581,289 | A | | 12/1996 | Firl et al. | |
| 5,633,668 | A | | 5/1997 | Schwiebert et al. | |
| 5,668,584 | A | | 9/1997 | Broder et al. | |
| 5,732,633 | A | | 3/1998 | Hershkowits | |
| 5,742,315 | A | * | 4/1998 | Szlucha et al. | 347/102 |
| 5,745,140 | A | | 4/1998 | Stoffel et al. | |
| 5,757,387 | A | | 5/1998 | Manduley | |
| 5,771,054 | A | | 6/1998 | Dudek et al. | |
| 5,831,655 | A | | 11/1998 | Asawa et al. | |
| 6,019,466 | A | * | 2/2000 | Hermanson | 347/102 |
| 6,048,059 | A | * | 4/2000 | Wafler | 347/102 |
| 6,132,038 | A | * | 10/2000 | Szlucha | 347/102 |
| 6,203,153 | B1 | * | 3/2001 | Barton | 347/105 |
| 6,231,176 | B1 | * | 5/2001 | Peter | 347/102 |

* cited by examiner

*Primary Examiner*—John Barlow
*Assistant Examiner*—Michael S. Brooke
(74) *Attorney, Agent, or Firm*—Dinsmore & Shohl LLP

(57) ABSTRACT

The present invention relates to an inkjet printer assembly. The inkjet printer assembly comprises a printhead and a tepidity device. The printhead is capable of providing droplets of ink on a portion of a print receiving medium within a print zone. The portion of the print receiving medium within the print zone is at least partially exposed to an atmosphere having a temperature. The tepidity device is capable of being in thermal contact with the droplets of ink provided on the portion of the print receiving medium within the print zone. The tepidity device is also capable of generally warming the droplets of ink provided on the portion to a temperature of about 16° Celsius above the temperature of the atmosphere to which the print zone is at least partially exposed while the portion is substantially

14 Claims, 6 Drawing Sheets

METHOD AND APPARATUS FOR FIXING INK TO A PRINT RECEIVING MEDIUM

TECHNICAL FIELD

The present invention relates to ink jet printers, and, more specifically, to a method and apparatus for fixing ink to a print receiving medium.

BACKGROUND OF THE INVENTION

Ink jet printers typically include recording heads, referred to hereinafter as printheads, that employ transducers which utilize kinetic energy to eject droplets of ink. For example, thermal printheads rapidly heat thin film resistors (or heaters) to boil a liquid-based ink, thereby ejecting a droplet of the ink onto a print receiving medium, such as paper. According to this ink jet method, upon firing a resistor, a current is passed through the resistor to rapidly generate heat. The heat generated by the resistor rapidly boils or nucleates a layer of ink in contact with or in proximity to a surface of the resistor.

The nucleation causes a rapid vaporization of the ink carrier or vehicle, creating a vapor bubble in the layer of ink. The expanding vapor bubble pushes a portion of the remaining ink through an aperture or orifice in a plate, so as to deposit one or more drops of the ink on a print receiving medium, such as a sheet of paper. The properly sequenced ejection of ink from each orifice causes characters or other images to be printed upon the print receiving medium as the printhead is moved relative to the print receiving medium.

Until the ink deposited on a print receiving medium has become fixed thereto, problems such as bleeding, cockling, and smearing can occur, especially when using inks having an aqueous-based carrier, and print receiving media such as plain paper. For example, bleeding can include both lateral bleeding and penetrating bleeding, and is generally caused by the absorption of the carrier into the print receiving medium. Lateral bleeding involves lateral movement of the ink through the print receiving medium (e.g., in paper, spreading across adjacent fibers of the paper). Penetrating bleeding, on the other hand, involves longitudinal movement of the ink through the print receiving medium (e.g., in paper, penetrating towards the back of the paper).

In general, lateral bleeding can reduce the definition of the resultant image. Meanwhile, penetrating bleeding can, for example, reduce optical density and hinder duplex printing. Furthermore, cockling, which also involves the absorption of the carrier into the print receiving medium, can deform the surface of the print receiving medium and induce waviness in the resultant image.

Smearing involves movement of the ink across the surface of the print receiving medium. For example, relative movement between a print receiving medium upon which ink has been deposited, but not fixed, and a second object (e.g., the hand of a user handling the object or another print receiving medium) can cause smearing. Accordingly, it is desirable for the ink deposited on a print receiving medium to be substantially fixed thereto before the user handles the medium and/or before the medium is placed in contact with the next print receiving medium. Therefore, as printing speeds have increased, a throughput limitation for ink jet printers has become the fixation time of the ink.

Conventionally, it is known to use surfactants to reduce the susceptibility of an ink to smearing (as well as reducing the susceptibility of the orifices of the printhead to clogging), but adding surfactants tends to increase the susceptibility of the ink to bleeding. In addition, printing methods, such as shingling methods, where only a fraction of the ink is deposited in each pass of the printhead, have been developed to reduce problems such as bleeding and cockling. Generally, as these methods involve depositing less ink per each pass, these methods typically increase the amount of passes needed, thereby adding additional time to the printing process and slowing the throughput of the printer.

Other attempted solutions to these problems have included exit stackers for separating a print receiving medium with unfixed ink from other print receiving media, and precoating print receiving media to limit the absorption of the carrier. However, these proposed solutions can be costly and may not adequately resolve all of the potential problems. Yet another approach to solving problems such as bleeding, cockling, and smearing has been to incorporate dryer devices within the printers. In some cases, multiple dryer devices have been utilized in the paper path of a printer.

Conventional dryer devices have utilized high temperatures and/or high air speeds to reduce the time required to fix the ink to the print receiving medium. Typically, these dryer devices will utilize powers between 750 to 1000 Watts, often causing the heating mechanisms in the dryer devices to glow orange hot, in an effort to speed the fixation time. As can be understood, because of the high temperatures involved, conventional dryer devices can present both bum and fire safety issues (e.g., when the user is exposed to the dryer device, such as when clearing paper jams or the like). Moreover, these devices are typically relatively large consumers of power, and can be obtrusive in the design of the printer.

Accordingly, it would be advantageous to have an inkjet printer and method for improving the fixation time of ink. It would also be advantageous to have an inkjet printer and method for improving print quality. Moreover, it would be advantageous to have such an inkjet printer and method that consumes relatively less power and reduces burn and/or fire safety issues. Furthermore, it would be desirable to have an inkjet printer and method which utilizes an unobtrusive device to meet these goals.

SUMMARY OF THE INVENTION

Accordingly, it is an object of the present invention to provide an inkjet printer and method that overcomes the problems associated with conventional inkjet printers.

It is another object of the present invention to provide an inkjet printer and method for improving the fixation time of a deposited ink.

It is a further object of the present invention to provide an inkjet printer and method for improving print quality.

Still another object of the present invention is to provide such an inkjet printer and method that consumes little power and reduces burn and/or fire safety issues.

Yet a further object of the present invention is to provide an inkjet printer and method which utilizes a tepidity device having an unobtrusive design.

According to one embodiment of the present invention, an inkjet printer assembly comprises a printhead and a tepidity device. The printhead is capable of providing droplets of ink on a portion of a print receiving medium within a print zone. The portion of the print receiving medium within the print zone is at least partially exposed to an atmosphere having a temperature.

Meanwhile, the tepidity device is capable of being in thermal contact with the droplets of ink provided on the portion of the print receiving medium within the print zone. The tepidity device is also capable of generally warming the droplets of ink provided on the portion of the print receiving medium within the print zone to a temperature of up to about 16° Celsius above the temperature of the atmosphere to which the print zone is at least partially exposed while the portion is substantially within the print zone. Preferably, the tepidity device is capable of being in conductive thermal contact with the droplets of ink provided on the portion of the print receiving medium.

In preferred ink jet printer assemblies according to this embodiment, the printhead includes a plurality of nozzles capable of ejecting the droplets of ink and the tepidity device generally opposes the nozzles of the printhead. According to another preferred embodiment, the tepidity device is capable of being in direct contact with the portion of the print receiving medium. Preferably, the tepidity device can generally warm the droplets of ink provided on the portion of the print receiving medium by being energized with a power of between about 6 to about 12 Watts. In yet another preferred embodiment of the present invention, the tepidity device is capable of generally warming the droplets of ink to a temperature of between about 40 to about 16° Celsius above the temperature of the atmosphere to which the print zone is at least partially exposed. Preferably, the tepidity device comprises an electrothermal converting element.

In another embodiment of the present invention, a method for printing on a print receiving medium includes the step of providing a portion of a print receiving medium in a print zone. The portion of the print receiving medium within the print zone is at least partially exposed to an atmosphere having a temperature. The method also includes providing ink onto selected locations of the portion of the print receiving medium within the print zone. Moreover, the method further includes generally warming the droplets of ink provided on the portion of the print receiving medium within the print zone to a temperature of up to about 16° Celsius above the temperature of the atmosphere to which the print zone is at least partially exposed while the portion is substantially within the print zone.

While the step of providing the ink can occur before or after the step of generally warming the droplets of ink, it preferably occurs substantially simultaneously with the step of generally warming the droplets of ink. A preferred embodiment of the present invention can also include the step of placing a tepidity device in thermal contact with the droplets of ink. In such an embodiment, the tepidity device is preferably placed in thermal contact with the portion of the print receiving medium within the print zone. In this embodiment, the tepidity device generally warms the portion of the print receiving medium to generally warm the droplets. In a more preferred embodiment, the method further includes the step of transferring thermal energy from the tepidity device to the portion of the print receiving medium after the step of placing a tepidity device in thermal contact with the portion of the print receiving medium within the print zone.

In a preferred embodiment, the step of generally warming the droplets of ink provided on the portion of the print receiving medium within the print zone also generally warms the droplets of ink to a temperature of between about 4° to about 16° Celsius above the temperature of the atmosphere to which the print zone is at least partially exposed. In other preferred embodiments, the preferred step of generally warming the portion of the print receiving medium within the print zone warms substantially all of that portion. In yet another preferred embodiment, the step of generally warming the droplets of ink provided on the portion of the print receiving medium within the print zone includes generally warming a tepidity device to a temperature of between about 4° to about 16° Celsius above the temperature of the atmosphere to which the print zone is at least partially exposed.

Still other aspects of the present invention will become apparent to those skilled in this art from the following description, wherein there is shown and described various embodiments of this invention, simply by way of illustration. As will be realized, the invention is capable of other different aspects and embodiments without departing from the scope of the invention. Accordingly, the drawings and descriptions should be regarded as illustrative in nature and not as restrictive in nature.

BRIEF DESCRIPTION OF THE DRAWINGS

While the specification concludes with claims particularly pointing out and distinctly claiming the invention, it is believed the same will be better understood from the following description taken in connection with the accompanying drawings in which:

DETAILED DESCRIPTION OF THE PREFERRED EMBODIMENTS.

Figure 1:
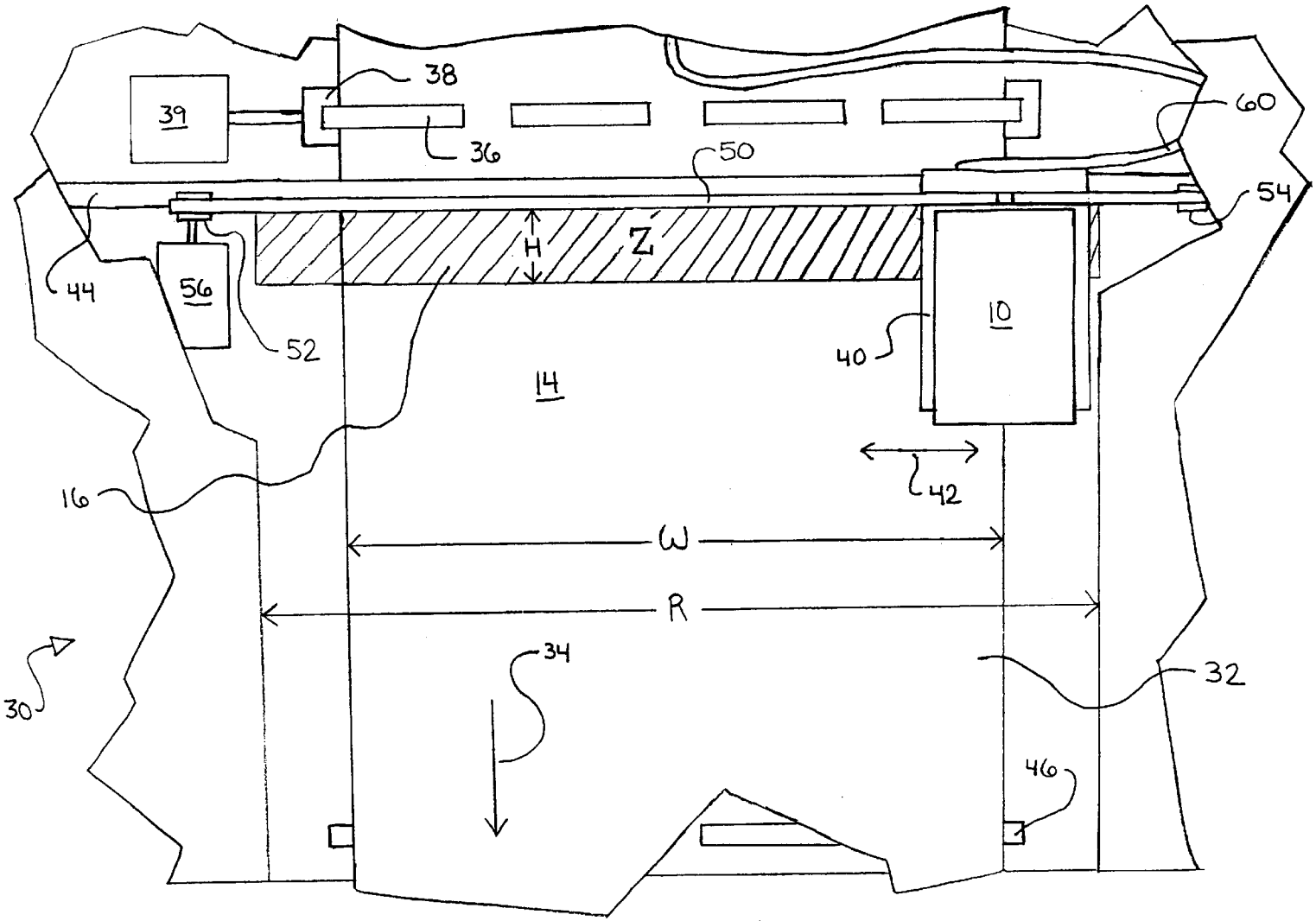
FIG. 1 is a schematic plan view of an inkjet printer assembly to which the novel method and apparatus of the present invention pertains.

Referring now to the drawings in detail, wherein like numerals indicate the same elements throughout the views, FIG. 1 illustrates an embodiment of an ink jet printer 30 to which the present invention can be applicable. A print receiving medium 32, which can be a recording medium made from paper, thin-film plastic or the like, can be moved in the direction of an arrow 34. Print receiving medium 32 can be guided by super-imposed pairs 36, 38 of sheet feed rollers, which can be under the control of a medium drive mechanism, such as a drive motor 39, for example. An exit roller 46 and star wheels (not shown) can also be utilized to guide print receiving medium 32.

Printheads 10 can be mounted on a carrier 40, which can be carried in close proximity to print receiving medium 32. As shown by arrow 42, printhead carrier 40 (and thus printhead 10 ) can be mounted for orthogonal, reciprocatory motion relative to the print receiving medium. To this end, carrier 40 can be mounted for reciprocation along a guide shaft 44.

The reciprocatory or side-to-side motion of carrier 40 can be established by a carrier drive, such as one having a transmission mechanism including a cable or drive belt 50 and pulleys 52, 54 which carry the belt driven by a motor 56. In this manner, printhead 10 may be moved and positioned at designated positions along a path defined by and under the control of the carrier drive and machine electronics. Carrier 40 and printhead 10 can be connected electrically by a flexible printed circuit cable 60 for supplying power from the power supply to printhead, and to supply control and data signals to printhead from the machine electronics, which includes the printer control logic (PCL).

Figure 2:
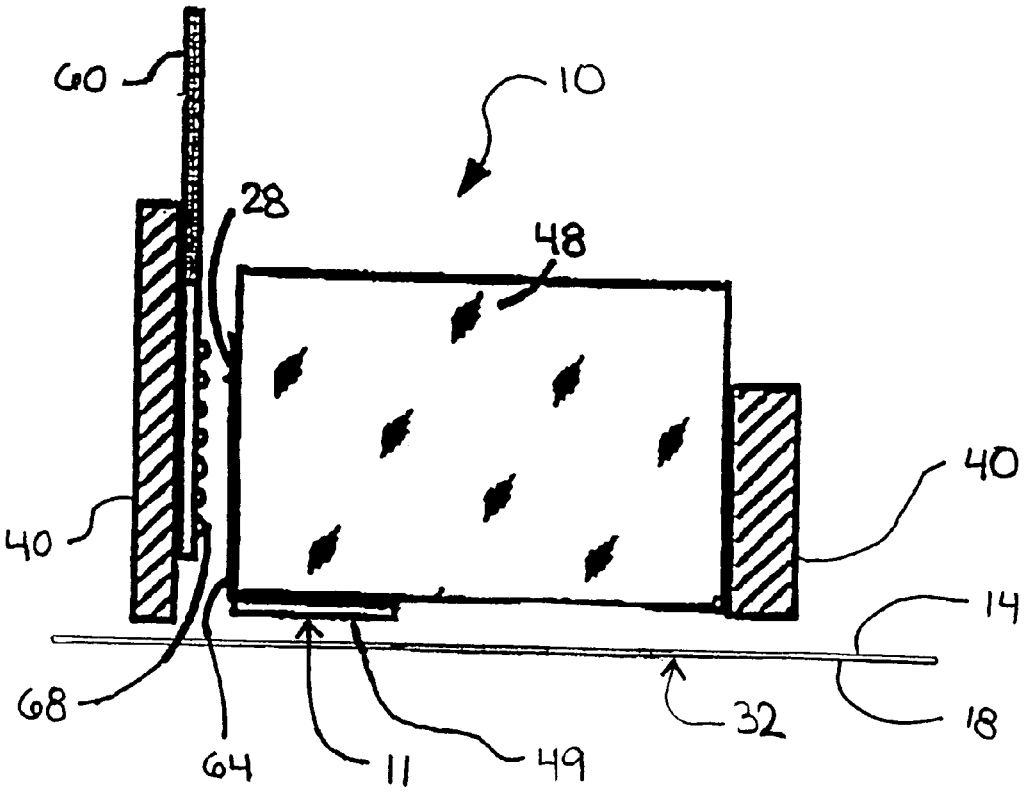
FIG. 2 is a selectively sectioned cross-sectional detail of an inkjet printer assembly.
Figure 3:
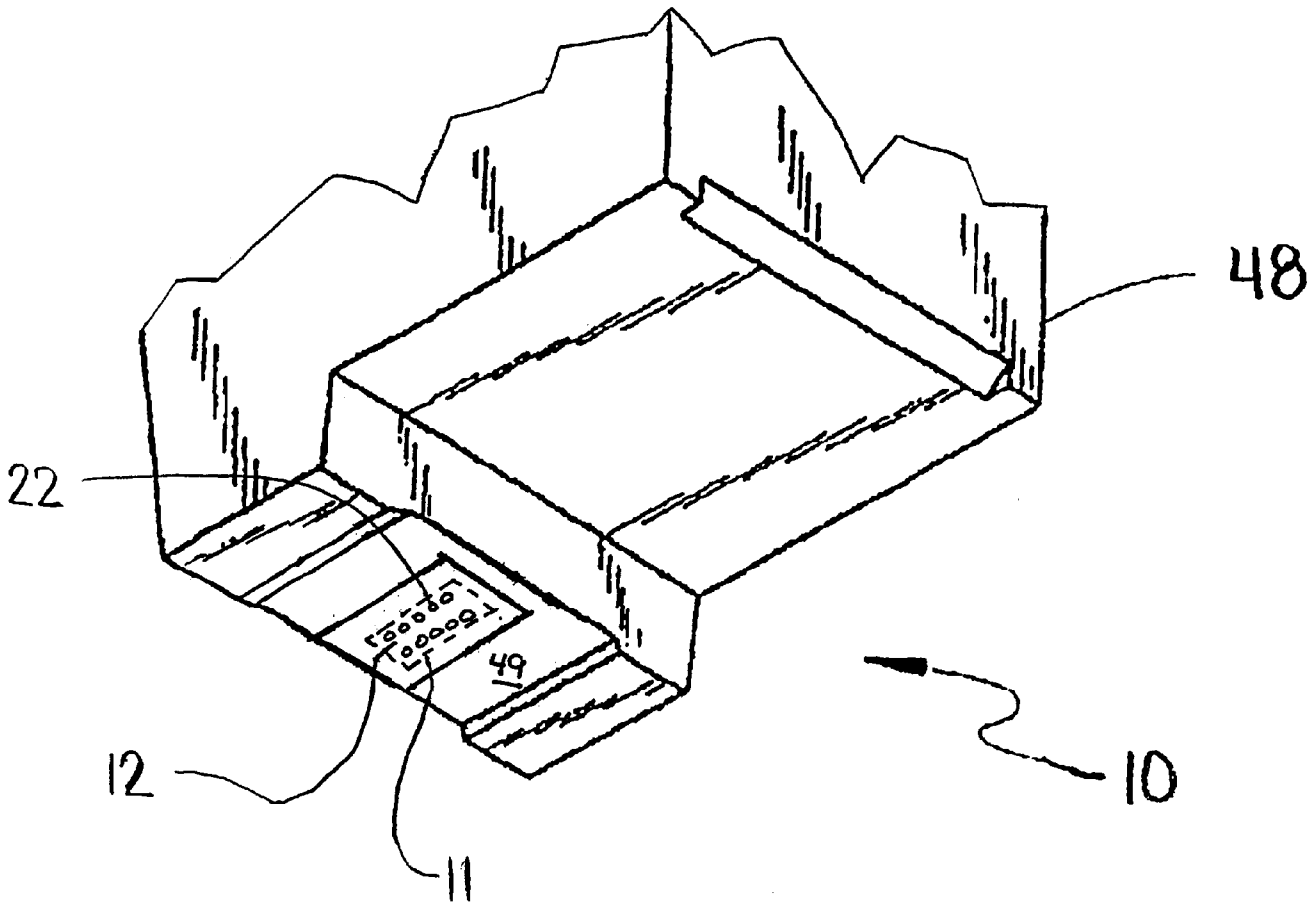
FIG. 3 is a partial perspective view of an inkjet printhead.

Referring now to FIGS. 2–3, according to one embodiment of the present invention, printheads 10 include printhead chips 11 attached, preferably by way of an adhesive bond, to a plate 12 having a plurality of individually selectable and actuable nozzle orifices or apertures 22. Printhead 10 can also include a supply of ink in, for example, an ink-holding reservoir 48, such as a tank or bottle. Preferably, nozzle plate 12 and chip 11 are bonded to a surface 49 on printhead 10. Surface 49 is capable of being arranged generally parallel to a print surface 14 of a print receiving medium 32. In one embodiment, surface 49 extends from ink reservoir 48, wherein the combination comprises an inkjet cartridge assembly.

According to this embodiment, nozzles 22 in plate 12 of printhead 10 confront print receiving medium 32. Accordingly, ink may be ejected by applying kinetic energy to the ink to effect printing on print receiving medium 32. It should be noted that the nozzles shown in the various figures are not to scale, and while a plurality are shown, the number is only by way of example.

Figure 4A:
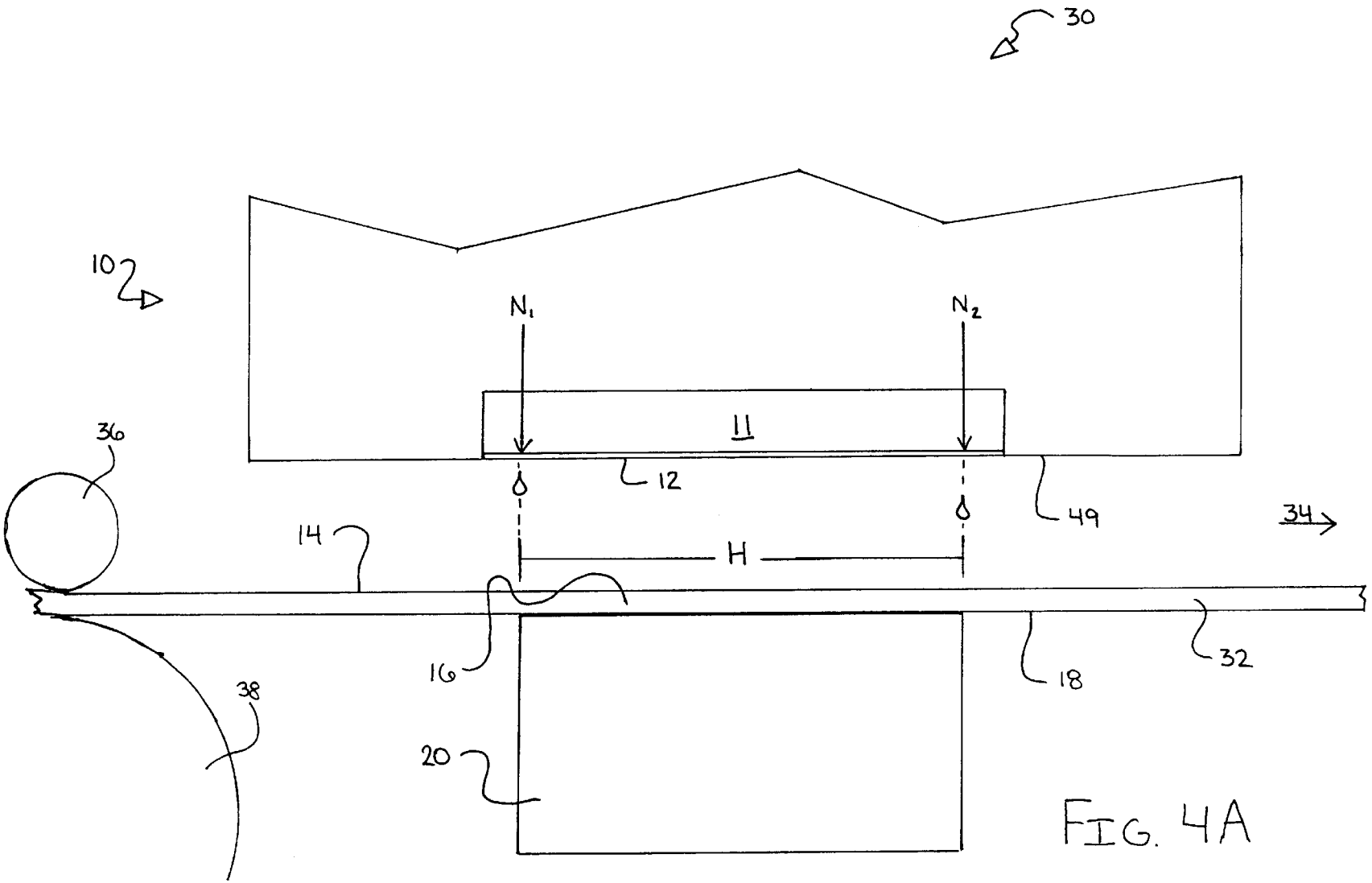
FIGS. 4A through 4B are selectively sectioned cross-sectional details of alternative inkjet printer assemblies according to the present invention.
Figure 4B:
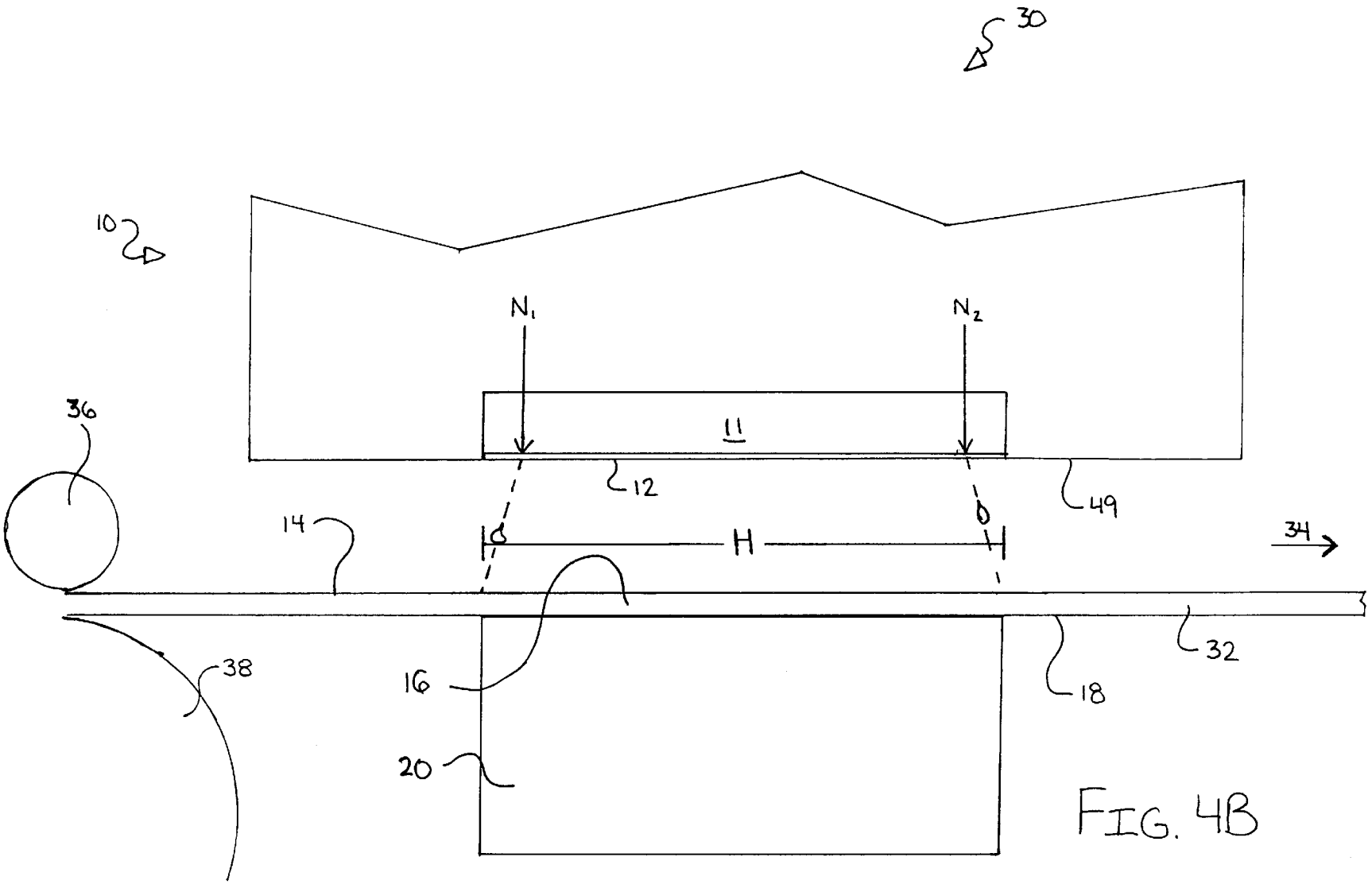

As shown in FIGS. 4A and 4B, depending upon the physical orientation of the nozzle plate 12 relative to print receiving medium 32, and by reference to the various figures, the longitudinal height or extent of nozzles 22, the diameter of the nozzles, the angularity of the nozzles, and the spacings between the nozzles determine the longitudinal size or height (H) of the print swath, and the lateral width and spacing of nozzles 22 determine the packing density and firing rate of printhead 10. As printing speeds and resolution density increase, larger and larger arrays of nozzles 22 are required. According to one embodiment of the present invention, each of nozzles 22 is separated from an adjacent nozzle by less than 1/300th of an inch and, more preferably, by approximately 1/600th of an inch. As can be understood by one of ordinary skill in the art, this separation is utilized to afford printhead 10 an operational printing resolution of about 600 dots per inch (DPI).

In the above structure, when printing occurs, simultaneously with the movement of carrier 40 in the direction of arrow 42 in FIG. 1, a droplet of ink can be selectively ejected from a nozzle by a fire pulse executed by the machine electronics in accordance with recording data. The fire pulse rapidly heats the ink to cause explosive boiling, called nucleation. Since nucleation occurs at or near the superheat limit of the ink, the resulting vapor bubble begins to grow with an initial pressure impulse greater than 100 atmospheres. The pressure pulse imparts momentum to the fluid ink.

Within several microseconds after nucleation, the vapor pressure inside the bubble is less than 1 atmosphere. The end effect is a short duration vapor bubble that displaces ink, resulting in a small droplet of ink being jetted from a nozzle. The ink droplets impinge upon the surface of the print receiving medium, wherein they form the recording information on the print receiving medium.

Generally, a paper path comprises a path by which print receiving media 32 must travel through ink jet printer 30 in order to have ink deposited thereon. Meanwhile, as illustrated in FIG. 1, a print zone (Z) comprises a location in printer 30 generally corresponding to an area on print surface 14 of a print receiving medium 32 onto which the respective operating printheads 10 of an ink jet printer can deposit ink if the print receiving medium 32 is not moving. The print zone (Z) is at least partially exposed to an atmosphere with a temperature.

Conventionally, most inkjet printers utilize a print receiving media feed mechanism, such as drive motor 39 and sheet feed rollers 36, 38, which moves a print receiving medium 32 in incremental steps. In addition, printheads 10 in conventional inkjet printers can typically print onto a print receiving medium 32 within a lateral range (R) generally encompassing the widths (W) of each type of print receiving media 32 which can be passed through their respective paper paths, before incrementing the respective print receiving medium 32. Accordingly, in an embodiment of the present invention utilizing conventional inkjet printer designs, the print zone (Z) preferably corresponds to a portion 16 of print receiving medium 32 generally defined by the height (H) of the print swath and the lateral range (R) of the respective operating printheads 10. The present invention, however, is also directed towards embodiments where the feed mechanism does not move print receiving medium 32 in incremental steps (e.g., when utilizing full width array printheads and continuous feed mechanisms) and/or where printer 30 cannot print across the entire width (W) of each type of print receiving media 32 which can be passed through the paper path.

Referring back to FIGS. 4A–4B, according to one embodiment of the present invention, a tepidity device 20 can be included in an inkjet printer assembly 30. When desired, tepidity device 20 can thermally contact droplets of ink which have been provided on a portion 16 of print receiving medium 32 within the print zone (Z). When activated, tepidity device 20 can also generally warm the droplets of ink on portion 16 to a temperature of up to about 16° Celsius above the temperature of the atmosphere to which the print zone (Z) is at least partially exposed. Preferably, tepidity device 20 can generally warm these droplets of ink to a temperature of between about 4° to about 16° Celsius above the temperature of the atmosphere to which the print zone (Z) is at least partially exposed.

Preferably, tepidity device 20 can be placed in conductive thermal contact with the droplets of ink provided on portion 16 of print receiving medium 32. For example, tepidity device 20 can be placed in direct contact with print receiving medium 32, such as on a surface 18 of the print receiving medium opposite print surface 14, and is preferably placed in contact with portion 16 of the print receiving medium, which is within the print zone (Z). One advantage of placing tepidity device 20 in direct contact with print receiving medium 32, in accordance with a preferred embodiment of the present invention, is that this can increase the speed by which thermal energy can be transferred from the tepidity device to the print receiving medium, thereby increasing the speed by which the thermal energy can be transferred from the tepidity device to the droplets of ink which have been deposited on portion 16.

Although tepidity device 20 can generally warm the droplets of ink provided on portion 16 of print receiving medium 32 at any time relative to when the droplets of ink were provided on the portion, it is preferred to generally warm these droplets of ink substantially simultaneously with their provision on the print receiving medium. In addition, although a tepidity device which can selectively and thermally contact only those areas of portion 16 of print receiving medium 32 which are in the print zone (Z) and have received droplets of ink is within the scope of the present invention, it is preferred to place the tepidity device in thermal contact with substantially all of the portion of the print receiving medium which is within the print zone (Z). Similarly, although a tepidity device can be selectively placed in thermal contact with a print receiving medium, it is preferably mechanically fixed in relation to a print receiving medium passing through the paper path of printer 30.

According to the present invention, a preferred tepidity device comprises an electrothermal converting unit, such as a heater, preferably with an unobtrusive design. In a preferred embodiment, an operating tepidity device can also be touched by an individual without the individual being burned. According to one embodiment of the present invention, a tepidity device can generally warm the droplets of ink provided on portion 16 when powered with less than about 12 Watts. For example, one preferred tepidity device can generally warm the droplets of ink provided on portion 16 when powered with between about 6 to about 12 Watts.

In a preferred embodiment of the present invention, tepidity device 20 includes a heater comprising thermally conductive material. One advantage of utilizing thermally conductive material is that it can speed the transfer of energy from the heater to the droplets of ink. Preferably, the heater also has low thermal mass. Providing a heater with low thermal mass can, for example, help speed the time it takes the heater to "heat up" (i.e., such a heater can have a fast thermal response).

For example, tepidity device 20 can comprise a flexible heater, such as one comprising a heating element insulated with a high density plastic, such as polyamide film. One example of a polyimide film, according to a preferred embodiment of the present invention, is that sold by the E. I. du Pont de Nemours and Company under the trademark KAPTON®. Advantages of using a material such as KAPTON® can include providing a heater with distributed wattage and zoned heating. Furthermore, the physical and mechanical properties of KAPTON®, such as its relative smoothness, for example, can be advantageous when placing such a component in repetitious contact with an abrasive print receiving medium such as paper. Commercially, such heaters are available from suppliers such as OMEGA Engineering, Inc., of Stamford, Conn., and Watlow Electric Manufacturing Company of St. Louis, Mo.

With reference to FIG. 1, according to an illustrative embodiment of the present invention including standard business print receiving media, tepidity device 20 preferably comprises a flexible heater with a heating surface area that extends for a distance in the direction of arrow 34 of greater than about 0.75 inches. More preferably, the heating surface area extends for a distance of about 0.75 to about 1.5 inches in the direction of arrow 34, with a heating surface area that extends for a distance of about 1.5 inches in the direction of arrow 34 being most preferred. According to this illustrative example of a preferred embodiment of the present invention, the heating surface area of tepidity device 20 extends for a distance of about 8 inches in a direction generally corresponding to arrow 42.

The heating surface area of such a tepidity device is preferably placed in physical contact with the print receiving medium 32 as it passes through the print zone (Z). According to a further preferred embodiment of the present illustrative example, the heating surface area of the heater remains in constant contact with the print receiving medium within the print zone (Z). An advantage of such an embodiment is illustrated according to the following example.

After being provided on a portion of the print receiving medium within the print zone (Z), such as portion 16, the droplets of ink begin absorbing energy from the tepidity device 20. As the droplets absorb energy, the evaporation rate of the carrier (e.g., water) of the ink increases. As the carrier evaporates, the droplets of ink typically cool to slightly below the ambient temperature, thereby slowing further evaporation of the carrier. Moreover, as the droplets of ink absorb energy, the respective corresponding area of the heater cools (e.g., from about 140° F. to about 110° F.).

With constant contact between the heater surface area and the print receiving medium 32, for example, the droplets of ink can continue to substantially absorb energy for the entire time the affected portion of the print receiving medium 32 is in contact with the heating surface area. Therefore, such an embodiment can help prevent the evaporation rate from decreasing. Furthermore, an additional advantage of such an embodiment can include that it reduces the affect of the aforementioned cooling of the areas on the heater. For example, according to the preferred embodiment being discussed herein, as the print receiving medium 32 moves relative to the heater, a "cool area" can be covered by an adjacent warmer area.

The present invention can, for example, provide the carrier of the affected droplets of ink with enough energy to speed the evaporation of the carrier, thereby reducing the amount of carrier which needs to be absorbed by print receiving medium 32. Consequently, print receiving medium 32 can dry in a reduced amount of time, and the overall print quality of a resultant image can be improved (e.g., less bleeding, less smearing and reduced cockling). Furthermore, by increasing the dry time and improving the overall print quality, the present invention can allow for greater latitude in ink chemistry design. For example, the present invention can be utilized to help offset print quality problems associated with using inks containing surfactants, thereby allowing for higher amounts of surfactants to be used in inks.

Figure 5:
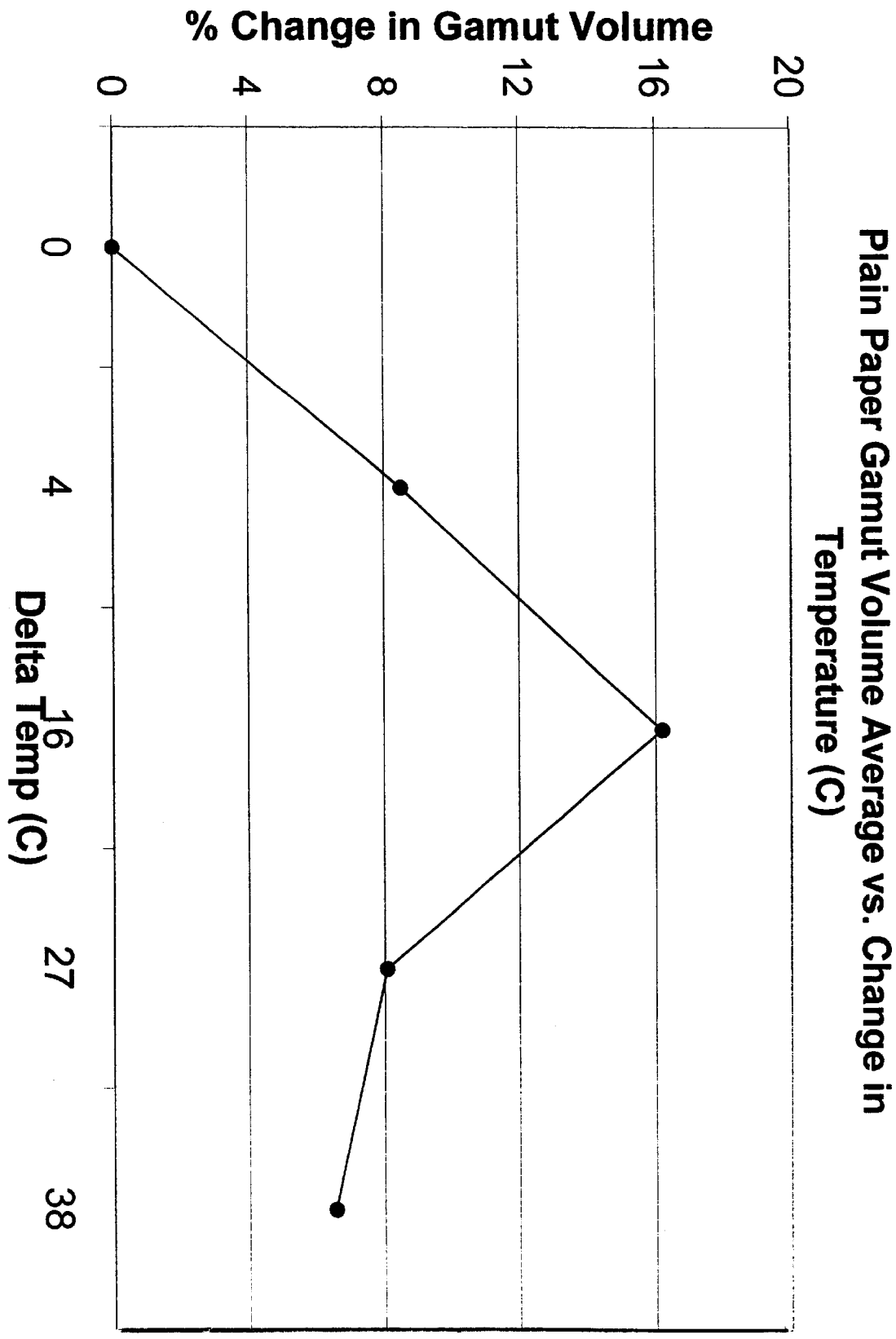
FIG. 5 is a plot of plain paper gamut volume average as a function of change in temperature.

Conventionally, dryer devices utilized high-temperatures to speed drying time. By comparison, the present invention utilizes relatively low temperatures that have an unexpectedly and proportionally greater effect on the drying time of the print receiving medium, as well as the print quality of any resultant image. For example, as shown in Table 1 and FIG. 5, utilizing the present invention to moderately warm the droplets of ink deposited on a portion of a print receiving medium, within the print zone and comprising plain paper, changed the resulting gamut volume, on average, by up to about 16%. Increasing the gamut volume is visible to a user of the present invention as brighter and darker colors, as well as more uniform blocks of color, in a resultant printed image. In addition, the present invention can also help reduce energy consumption and burn/fire safety concerns.

TABLE 1

Percentage Increase in Gamut Volume Per Change in Temperature for Plain Paper Types

| Paper Type | Δ0° C. | Δ4° C. | Δ16° C. | Δ27° C. | Δ38° C. |
|---|---|---|---|---|---|
| Yuen Foong Yu 20# | 0 | 4 | 6.1 | 6.4 | |
| Matrix Xerographic | 0 | 5.7 | 40.7 | 12.5 | 12 |
| Cascade X9000 | 0 | 5.4 | 7.3 | 7 | 8.7 |
| Xerox 4024 20# | 0 | 5.7 | 19.8 | 11.4 | 12.4 |
| Tibesti Laser Line | 0 | 8.3 | 17.2 | 14.5 | 16.9 |
| Hammermill Lasermill 32# | 0 | 4.6 | 10.3 | 13.2 | 12.1 |
| Gilbert Bond 16# | 0 | 5.2 | 18.6 | 16.9 | 4.1 |
| Classic Linen Writing Avon Brilliant White | 0 | 18.8 | 10.7 | −18.9 | −21.7 |

TABLE 1-continued

Percentage Increase in Gamut Volume Per Change in Temperature for Plain Paper Types

| Paper Type | Δ0° C. | Δ4° C. | Δ16° C. | Δ27° C. | Δ38° C. |
|---|---|---|---|---|---|
| Strathmore Writing Bright White Wove 24# | 0 | 9.8 | 25.4 | 10.4 | 5.4 |
| Hammermill Lasermill Xerox/Lasercopy 20# | 0 | 0.6 | 11.1 | −2.6 | 4.7 |
| Crane's Crest Fluorescent White Wove 24# | 0 | 27.2 | 30.5 | 30.4 | 29.6 |
| Hammermill Bond Writing 20# | 0 | | 9.5 | 6.5 | 5.7 |
| Fox River Bond Arctic White 16# | 0 | 10.5 | 8.1 | 7 | 2.5 |
| Lancaster Bond/Gilbert 24# | 0 | −2.6 | | −2.2 | −6.4 |
| Xerox High Tech Laser 24# | 0 | 12.6 | | 8.1 | 5.4 |
| Certificate Bond 24# | 0 | 12 | 11.1 | 8.3 | 6.8 |
| Specialty Papers | | | | | |
| Lex High Res Prem Ink Jet | 0 | 2.9 | 65.8 | | 3.6 |
| Lexmark InkJet Photo Paper | 0 | 12.8 | 8 | −2 | |
| Average for Plain Paper | 0 | 8.5 | 16.2 | 8.1 | 6.5 |

The foregoing description of the preferred embodiments of the present invention has been presented for purposes of illustration and description. It is not intended to be exhaustive or to limit the invention to the precise form disclosed, and modifications and variations are possible in light of the above teachings. For example, although the discussion and examples have centered on the use of plain paper in conjunction with the present invention, it can be used with card stock, coated paper, photo paper, and other specialty papers, as well as other print receiving media in addition to those described or shown, without departing from the scope of the invention. Moreover, although one advantage of the present invention is that it alleviates the need to use additional devices, such as pre-heating devices, to help dry a print receiving medium and improve the print quality of any resultant image thereon, it can be used in conjunction with such devices if so desired.

Thus, it should be understood that the embodiments were chosen and described in order to best illustrate the principals of the invention and its practical application. This illustration was provided to thereby enable one of ordinary skill in the art to best utilize the invention in various embodiments and with various modifications as are suited for the particular use contemplated. Accordingly, it is intended that the scope of the invention be defined by the claims appended hereto.

We claim:

1. A method for printing on a print receiving medium comprising the steps of:

a. providing a portion of a print receiving medium in a print zone, the portion of the print zone receiving medium within the print zone being at least partially exposed to an atmosphere having a temperature;

b. providing droplets of ink onto selected locations of the portion of the print receiving medium within the print zone;

c. generally warming the droplets of ink provided on the portion of the print receiving medium within the print zone to a temperature of up to about 16° Celsius above the temperature of the atmosphere to which the print zone is at least partially exposed while the portion is substantially within the print zone;

wherein the step of providing droplets of ink occurs before the step of generally warming the droplets of ink.

2. The method for printing according to claim 1, wherein the step of placing a tepidity device in thermal contact with the droplets of ink comprises placing the tepidity device in thermal contact with the portion of the print receiving medium, and generally warming the portion to generally warm the droplets of ink.

3. The method for printing according to claim 2, further comprising the step of transferring thermal energy from the tepidity device to the portion of the print receiving medium after the step of placing a tepidity device in thermal contact with the portion of the print receiving medium.

4. The method for printing according to claim 2, wherein the step of generally warming the portion warms substantially all of the portion.

5. The method for printing according to claim 1, wherein the step of generally warming the droplets of ink provided on the portion of the print receiving medium within the print zone generally warms the droplets of ink to a temperature of between about 4° to about 16° Celsius above the temperature of the atmosphere to which the print zone is at least partially connected.

6. The method for printing according to claim 1, wherein the step of generally warming the droplets of ink provided on the portion of the print receiving medium comprises generally warming a tepidity device to a temperature of between about 4 to about 16 Celsius above the temperature of the atmosphere to which the print zone is at least partially exposed.

7. The method for printing according to claim 1, further comprising the step of placing a tepidity device in thermal contact with the droplets of ink.

8. A method for printing on a print receiving medium comprising the steps of:

a. providing a portion of a print receiving medium in a print zone, the portion of the print zone receiving medium within the print zone being at least partially exposed to an atmosphere having a temperature;

b. providing droplets of ink onto selected locations of the portion of the print receiving medium within the print zone;

c. generally warming the droplets of ink provided on the portion of the print receiving medium within the print zone to a temperature of up to about 16° Celsius above the temperature of the atmosphere to which the print zone is at least partially exposed while the portion is substantially within the print zone;

wherein the step of providing droplets occurs after the step of generally warming the droplets of ink.

9. The method for printing according to claim 8, further comprising the step of placing a tepidity device in thermal contact with the droplets of ink.

10. The method for printing according to claim 8, wherein the step of placing a tepidity device in thermal contact with the droplets of ink comprises placing the tepidity device in thermal contact with the portion of the print receiving medium, and generally warming the portion to generally warm the droplets of ink.

11. The method for printing according to claim 10, further comprising the step of transferring thermal energy from the tepidity device to the portion of the print receiving medium after the step of placing a tepidity device in thermal contact with the portion of the print receiving medium.

12. The method for printing according to claim 10, wherein the step of generally warming the portion warms substantially all of the portion.

13. The method for printing according to claim 8, wherein the step of generally warming the droplets of ink provided on the portion of the print receiving medium within the print zone generally warms the droplets of ink to a temperature of between about 4° to about 16° Celsius above the temperature of the atmosphere to which the print zone is at least partially connected.

14. The method for printing according to claim 8, wherein the step of generally warming the droplets of ink provided on the portion of the print receiving medium comprises generally warming a tepidity device to a temperature of between about 4 to about 16 Celsius above the temperature of the atmosphere to which the print zone is at least partially exposed.

* * * * *